United States Patent [19]

Cain

[11] 4,026,416

[45] May 31, 1977

[54] LIGHT BULB STORAGE BANK

[75] Inventor: John M. Cain, Rumson, N.J.

[73] Assignee: The Raymond Lee Organization, Inc., New York, N.Y. ; a part interest

[22] Filed: Oct. 14, 1975

[21] Appl. No.: 621,692

[52] U.S. Cl. ..... 211/26; 312/223

[51] Int. Cl.[2] ..... A47F 7/00

[58] Field of Search ..... 211/26, 49; 240/2 AD, 240/6; 340/381; 312/117, 223; 206/418–422; 324/20, 158 R

[56] References Cited

UNITED STATES PATENTS

| | | | |
|---|---|---|---|
| 1,911,826 | 5/1933 | Kaelber | 211/26 X |
| 2,317,426 | 4/1943 | Wilson | 211/26 X |
| 2,409,484 | 10/1946 | Gauthier | 211/26 |
| 2,960,235 | 11/1960 | Farber et al. | 211/26 |
| 3,220,000 | 11/1965 | Lesage | 340/381 X |
| 3,644,009 | 2/1972 | Tyler | 312/223 X |
| 3,666,113 | 5/1972 | Burrell | 211/26 |

*Primary Examiner*—Ramon S. Britts
*Assistant Examiner*—Terrell P. Lewis
*Attorney, Agent, or Firm*—Howard I. Podell

[57] ABSTRACT

A rack fitted with a series of open recesses each of a size to store a plurality of electric light bulbs, with socket fastening means internally mounted to a back plate of the rack to individually fasten the male threaded base plug of the stored bulbs. A tester socket, connected to a portable electrical line cord permits testing of any bulb removed from the rack. Additional recesses are provided for spare fuses and other accessories.

2 Claims, 3 Drawing Figures

LIGHT BULB STORAGE BANK

SUMMARY OF THE INVENTION

My invention is a rack fitted with a series of open recesses each of a size to store a plurality of electric light bulbs, with socket fastening means internally mounted to a back plate of the rack to individually fasten the male threaded base plug of the stored bulbs. A tester socket, connected to a portable electrical line cord permits testing of any bulb removed from the rack. Additional recesses are provided for spare fuses and other accessories.

BRIEF DESCRIPTION OF THE DRAWINGS

The objects and features of the invention may be understood with reference to the following detailed description of an illustrative embodiment of the invention taken together with the accompanying drawings in which.

DESCRIPTION OF THE PREFERRED EMBODIMENT

Figure 1:
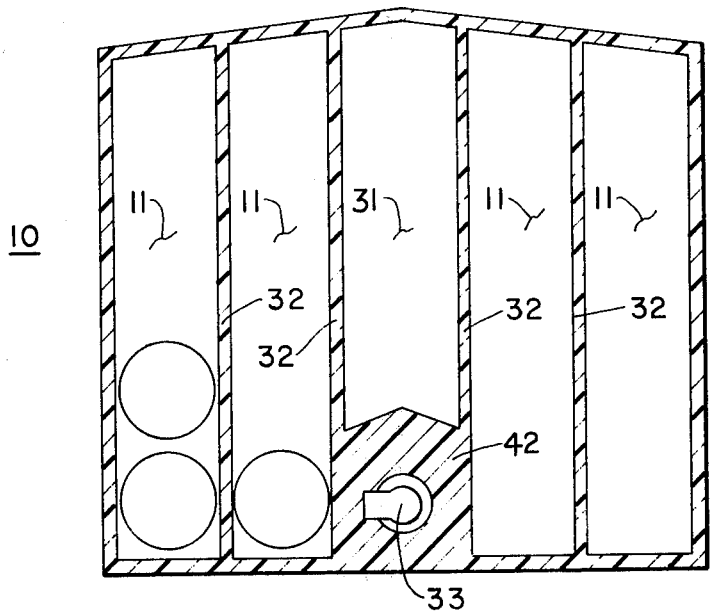
FIG. 1 is a sectional view in elevation of the rack.
Figure 2:
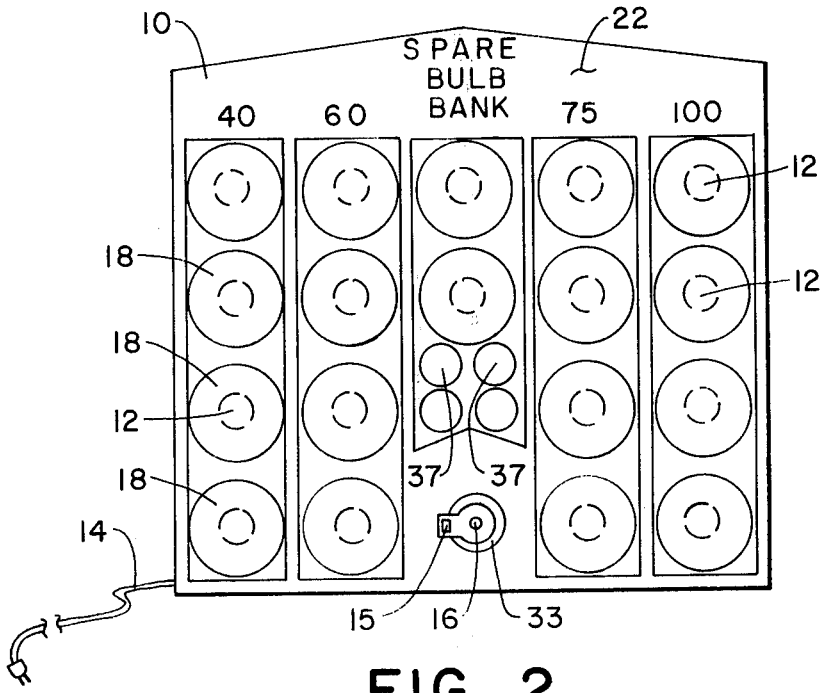
FIG. 2 is a front elevation view of the rack.
Figure 3:
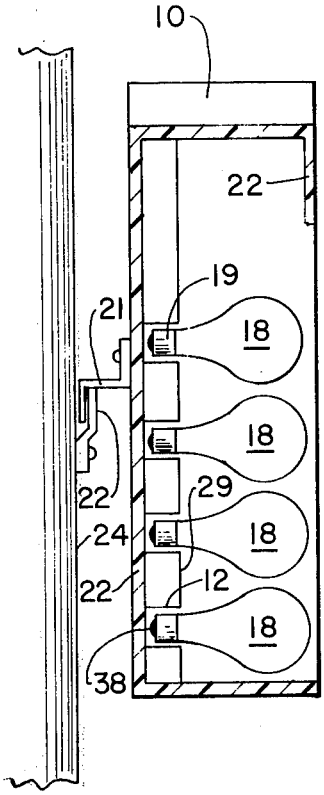
FIG. 3 is a side sectional view of the rack.

Turning now descriptively to the drawings, in which similar reference characters denote similar elements throughout the several view, FIGS. 1–3 illustrate the light bulb storage rack 10, which may be fastened by a bracket 21 attached exernally of the back plate 22 to a clip 23 fastened to a wall 24.

The front face 26 of the rack is open permitting ready access to light bulbs 18 which may be individually threaded to sockets 12 recessed in the interior surface 29 of the back plate 22. Sockets 12 may be fitted with the conventional female Edison screw ferrules or alternately sockets 12 may be each a cylindrical recess fitted with a spring detent for fastening about the male thread of a light bulb base 19.

The individual storage compartments 11 are separated preferably by divider walls 32 with a central compartment 31 mounted above a central section 42 in which a test socket 33 is fixed. Test socket 33 is a cylindrical recess fitted into section 42 of a size to freely fit about a lamp bulb socket 19 and is fitted with an electrical contact 16 located to engage the central stud contact 38 of a lamp bulb socket and a spring metal detent arm 15 located in a side recess 37 of socket 33 which engages the metal thread of an inserted lamp bulb socket 19.

Contacts 15 and 16 are connected to the conductors of a portable electrical line cord 14.

Compartments 31 may be fitted with sockets 12 located close to each other for storage of plug fuses 37.

A face board 25 extends across the top of the front of the rack 10 above the open resesses 11 and 31, with markings 45 on the face board indicating recommended locations for storage of various size light bulbs 18.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A rack for storage of various size of light bulbs comprising a back plate fixed to spaced divider partitions enclosing open recesses in which light bulbs may be stored, with a plurality of socket means, each adaptable for the individual retention of a light bulb base, fixed to the internal side of the back plate and located so that a plurality of said socket means are located in each open recess, said socket means spaced apart from each other and from the divider partitions to provide clearance between light bulbs fixed to said socket means, together with a face board mounted externally across the rack with markings on the face board to indicate the recommended locations for individual storage of light bulbs of a common size in each said open recess.

2. The combination as recited in claim 1 in which a recess is fitted with closely spaced sockets adaptable for the storage of plug fuses.

* * * * *